US005625162A

United States Patent [19]

Appleby

[11] Patent Number: 5,625,162

[45] Date of Patent: Apr. 29, 1997

[54] SIGNAL TUBE OF IMPROVED OIL RESISTANCE

[75] Inventor: Rodney W. Appleby, Camira, Australia

[73] Assignee: ICI Australia Operations Pty Ltd, Melbourne, Australia

[21] Appl. No.: 358,375

[22] Filed: Dec. 19, 1994

[30] Foreign Application Priority Data

Dec. 20, 1993 [AU] Australia ..... PM3053

[51] Int. Cl.[6] ..... F42B 3/00

[52] U.S. Cl. ..... 102/331; 102/324; 102/275.4; 102/275.12

[58] Field of Search ..... 102/324, 331, 102/275.4, 275.12

[56] References Cited

U.S. PATENT DOCUMENTS

| | | | |
|---|---|---|---|
| 3,534,685 | 10/1970 | Romocki et al. | 102/324 |
| 3,617,593 | 11/1971 | Alderfer | 102/275.4 X |
| 4,493,261 | 1/1985 | Simon et al. | 102/331 |
| 4,942,817 | 7/1990 | Ikeda et al. | 102/331 |
| 5,138,949 | 8/1992 | Swartout et al. | 102/431 |
| 5,208,419 | 5/1993 | Greenhorn et al. | 102/275.4 |

*Primary Examiner*—Peter A. Nelson
*Attorney, Agent, or Firm*—Charles Q. Buckwalter

[57] ABSTRACT

The invention relates to oil resistant signal tube, in particular, to initiating explosives or explosives accessories which comprise signal tube. The signal tube of the invention has a sub-tube comprising polyethylene and an outer jacket comprising a thermoplastic polyurethane resin of the polyester type.

14 Claims, 1 Drawing Sheet

SIGNAL TUBE OF IMPROVED OIL RESISTANCE

Figure 1:
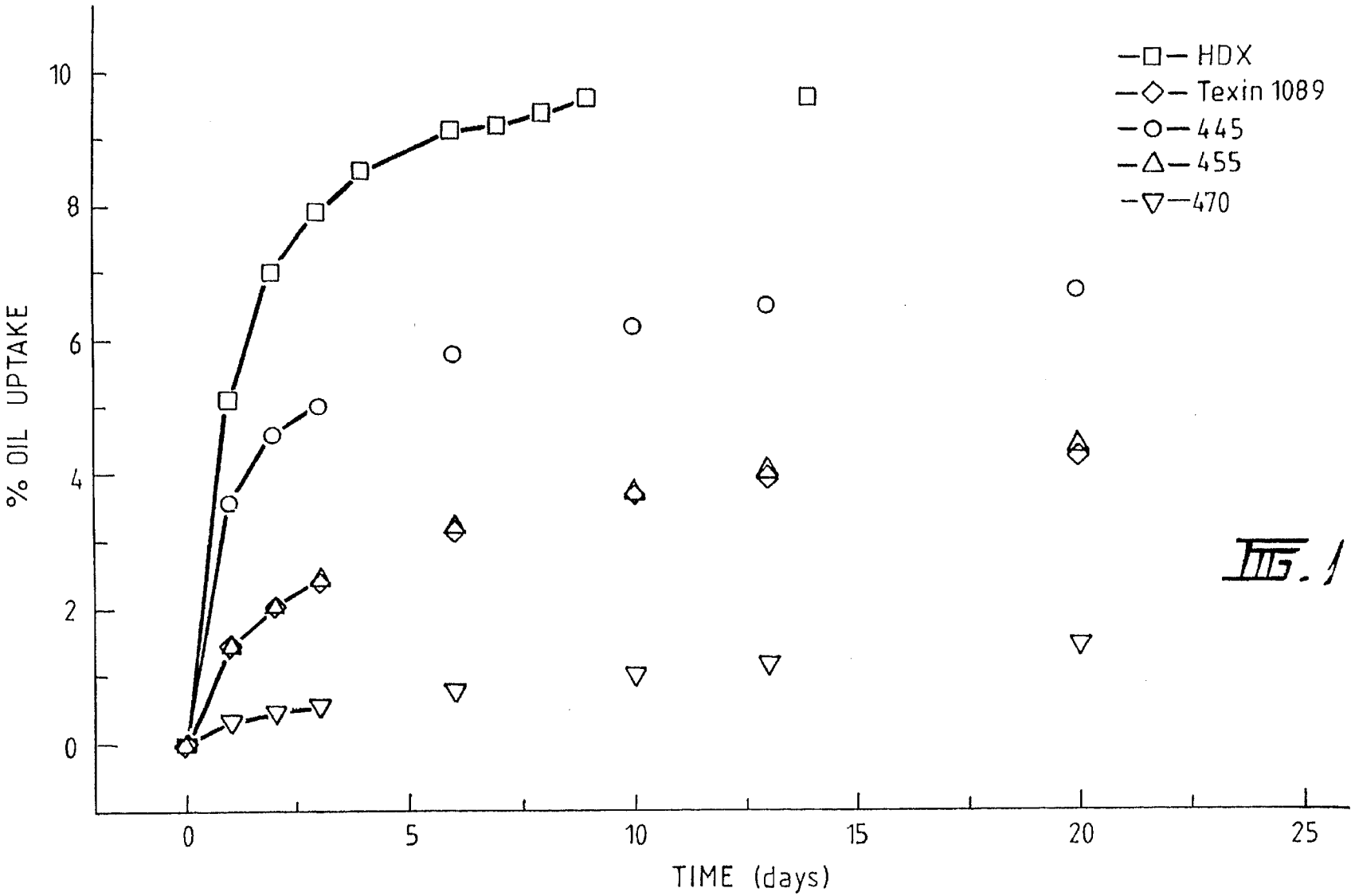

The present invention relates to oil resistant signal tube, in particular to initiating explosives or explosives accessories comprising oil resistant signal tubes.

Initiating explosives or explosives accessories are articles designed to contribute to the activation of a larger mass of explosive such as boreholes full of bulk or packaged explosives. One of the better known types of initiating explosives are detonators which comprise a metal shell in which is packed a small quantity of high energy explosive which may be used to detonate a slightly larger mass of explosive such as a primer which in turn may detonate with enough force to initiate a borehole loaded with bulk or packaged explosives.

Initiating explosives may also perform the function of transmitting initiation signals from one place to another using electrical or chemical (non-electrical) energy. These types of initiating explosives are commonly used to transmit initiating signals from a starting point to one or more detonators located in boreholes loaded with explosives. In general, signal tube is used to transmit an initiation signal to a non-electric detonator, while electrical legwires transmit an electrical initiation signal to electrical detonators.

Non-electric initiation means such as detonating cord and signal tubing comprise tubing which encloses a composition capable of detonation or rapid burning from one end of the tubing to the other.

Signal tube is widely used for blasting in Australia because, when compared to electrical systems, it provides a high level of safety against accidental initiation by static electricity, stray electrical currents and radio frequency energy. Unlike detonating cord, signal tube has the advantage of being almost silent as it functions. Signal tube cannot be initiated by flame, friction or impact under normal use and has proved tough enough for widespread use even in the rough conditions encountered in mines.

Signal tube usually comprises a length of hollow plastic tubing which has an inner coating of reactive powder, one end of the signal tube being crimped into a detonator shell while the other end is closed off by a waterproof seal. The initiation signal from the signal tube generally passes to a pyrotechnic delay element and then to a high explosive base charge which are both located within the detonator shell.

Signal tube of the prior art has commonly comprised an inner sub-tube formed from either SURLYN or linear low density polyethylene (LLDPE) or blends thereof, which is overcoated with a polyethylene (PE) outer jacket. (SURLYN is a trade mark). One of the major problems associated with signal tube comprised of PE is that it permits the diffusion of fuel oil through the walls. As a result the oil soaks into the inner coating of reactive powder, desensitising the powder and thus preventing the tube from firing. As the majority of explosives used in mining at the current time are ammonium nitrate and fuel oil (ANFO) mixtures or water-in-oil emulsion explosives, it is common for signal tube to come into contact with fuel oil.

Efforts have been made in the past to overcome problems of ingress of oil into signal tube by substituting different polymeric materials in the sub-tube and outer jacket however it has not hitherto been possible to construct a signal tube which is not only oil resistant but also meets the performance criteria required of signal tube. Because signal tube is often used in rugged mining conditions it must be quite abrasion resistant, yet flexible enough to be conveniently coiled for storage or contorted and forced into bunch-blocks, J-clips or other devices for connecting signal tube to other initiating means.

The materials chosen for construction of the sub-tube and outer jacket must also exhibit sufficient chemical or mechanical bonding such that the sub-tube cannot easily be easily pulled out of the jacket nor the jacket peeled off. Many years ago efforts were made to use thermoplastic polyurethanes (TPU's) as sub-tubing in signal tubes but these compounds were unsuccessful as they tended to be easily pulled out of the outer jacket and they exhibited poor oil resistance.

More recently, TPU's have undergone significant development in their chemistry and processing and new thermoplastic polyurethane resins of the polyester type can be produced. It has now been found that signal tube of improved oil resistance and suitable mechanical characteristics can be provided by combining a PE sub-tube with a jacket comprising certain types of these new TPU resins of the polyester type.

The present invention provides a signal tube of improved oil resistance comprising polyethylene and an outer jacket comprising a thermoplastic polyurethane resin of the polyester type.

Thermoplastic polyurethane resins of the polyester type are generally prepared by contacting under reactive conditions, a polyester polyol, a chain-extending agent and a diisocyanate. The extent of cross linking and physical characteristics of the resultant polyester based TPU are dependant on the properties and proportions of reactants used. With respect to the reactants which form the polyurethane resin of the polyester type, it is particularly preferred that for each mole of polyol present, the chain extending agent is present in a proportion of from 2.5 to 7 and the diisocyanate is present in a proportion of from 3 to 8.

The exact proportion of chain extending agent will depend on the desired hardness of the resulting resin and the molecular weight of the polyol. It is particularly preferred that the chain-extending agent is a dihydroxyl chain-extending agent having a molecular weight of 400 or less. The chain-extending agent may comprise aliphatic, cycloaliphatic or aromatic dihydroxyl compounds, or diols, having from 2 to 10 carbon atoms, for example, ethylene glycol. It is also possible to utilise mixtures of two or more diols or an admixture of a chain-extending agent and another compound. Typical chain extending agents are describe in U.S. Pat. No. 3,963,679 by Bayer.

It is also possible to combine the chain-extending agent with small amounts of monofunctional or trifunctional compounds such as alcohols, glycerine or trimethylpropane. These compounds may be used to modify physical properties or processing characteristics of the thermoplastic polyurethane resin.

Suitable polyester polyols for use in the present invention include any of the conventional polyester diols known in the an such as poly(alkylene alkanedioate)diols and poly (oxycaproyl)diols. Poly(ethylene adipate)diols, poly (propylene adipate)diols and poly(butylene adipate)diols are particularly preferred. Polyester polyols of average molecular weight between 500 and 5000 and having an average functionality of from 1.8 to 2.25 are particularly preferred. Typical poly(alkylene alkanedioate)diols suitable for use in the current invention are described in, for example, U.S. Pat. No. 2,423,823. Typical poly(oxycaproyl)diols are described in U.S. Pat. Nos. 3,169,945; 3,248,417; 3,021,310; 3,021,311; 3,021,312; 3,021,313; 3,021,314; 3,021,315; 3,021,316 and 3,021,317 and may other suitable compounds are known in the art.

The diisocyanate is preferably present in a quantity sufficient to provide an overall reaction index of between 0.8 and 1.2, where the isocyanate reaction index is defined as the number of isocyanate groups per active hydrogen present in the reactive composition. Suitable diisocyanates for use in the current invention include aliphatic, aromatic or alicyclic isocyanates or mixtures thereof. Preferably the diisocyanate is an aromatic diisocyanate such as the various isomers diphenylmethane diisocyanate and modified forms thereof such as are described in U.S. Pat. Nos. 3,394,164; 3,883,571; 4,115,429; 4,118,411; 4,299,347 and 3,384,653.

The thermoplastic polyurethane resin for use in the current invention may be prepared according to any suitable method such as those described in U.S. Pat. No. 3,963,679. The thermoplastic polyurethane resin may optionally further comprise any suitable additives including dyes, pigments, antioxidants, UV-stabilisers, processing aids such as waxes, lubricants, antistatic agents, organic and inorganic fillers, glass fibre-reinforcing agents or other plastics.

In a preferred embodiment, the signal tube of the current invention comprises an outer jacket of DESMOPAN 385, low wax versions of DESMOPAN 385 and TEXIN DP7-1089. (DESMOPAN is a trade name of Bayer Chemical Corporation; TEXIN is a trade name of Miles Incorporated, USA). The DESMOPAN and TEXIN materials have a similar composition an differ mainly in hardness. They are poly-addition products produced from a reaction mixture comprising;

(a) a poly(butanediol adipate) with a hydroxyl number of about 50 (DESMOPAN) 56 (TEXIN), (b) butanediol as a chain extender in an amount to obtain the desired hardness of the product, (c) 4,4'-diphenylmethanediisocyanate (MDI) having an NCO/OH index of 0.99 to 1.03, and (d) additives such as antioxidants and wax.

DESMOPAN KA 487 TPU additionally comprises about 10% of an inorganic filler such as talc.

The signal tube of the current invention may be manufactured by any convenient method known in the art such as overextruding the TPU jacket onto the PE sub-tube such that the TPU undergoes shrinkage sufficient to provide a mechanical bond between the jacket and the sub-tube. The signal tube of the current invention may further comprise a tie-layer to act as a mechanical or chemical anchor between the jacket and sub-tube. For example, CHEMLOK adhesive has been found to be particularly effective as a chemical anchor between the anchor and sub-tube. (CHEMLOCK is a trade mark).

The invention is further described with reference to the following examples which are given for illustrative purposes only:

COMPARATIVE EXAMPLE

Pieces of signal tube of conventional LLDPE sub-tube and PE jacket construction were closed off at each end and left to soak in MOBIL diesel fuel at 50° C. These pieces of signal tube were tested periodically to see if they could be initiated and the results are recorded in Table 1.

EXAMPLE 1

A sub-tube of LLDPE was overextruded with a jacket of DESMOPAN 385 TPU to form a composite tube which was used in the manufacture of signal tube. A significant degree of shrinkage of the DESMOPAN 385 TPU was observed and the sub-tube could not be removed from the jacket. Pieces of the signal tube so formed were closed off at each end and left to soak in MOBIL diesel fuel at 50° C. and tested periodically to see if they would initiate. The firing characteristics of the tubing are recorded in Table 1.

It is clear from the results in Table 1 that the DESMOPAN 385 TPU jacket provided better resistance to oil ingress compared with the conventional PE jacket.

During handling it was observed that the signal tube having a jacket of DESMOPAN 385 TPU showed far superior flexibility to the conventional PE jacketed signal tube, the latter being stiff, difficult to handle and prone to recoil. The DESMOPAN 385 TPU jacketed tube was flexible enough that it could be coiled into a ball, and when released, could be shaken out straight.

EXAMPLE 2

A sub-tube of LLDPE was overextruded with DESMOPAN KU 2-8710 TPU, a low wax content version of DESMOPAN 385 TPU to form a composite tube which was used in the manufacture of signal tube. The characteristics of these TPUs are recorded in Table 2. Good adhesion was exhibited between the sub-tube and the jacket. This signal tube was tested by soaking in diesel oil in the same manner as the signal tube of Example 1 and the firing results recorded in Table 1.

EXAMPLE 3

A sub-tube of LLDPE was overextruded with a jacket of DESMOPAN KA 8487, a filled TPU whose characteristics are recorded in Table 2. This signal tube was tested in diesel oil in the same manner as the signal tube of Example 1 and the results recorded in Table 1.

The oil resistance of signal tube comprising a jacket of DESMOPAN KA 8487 TPU was significantly greater than that of conventional PE jacketed signal tube but not significantly different to the oil resistance of tubing comprising a DESMOPAN 385 TPU jacket.

EXAMPLE 4

A composite tube was formed by overextruding a sub-tube of LLDPE with a jacket of TEXIN DP 1089, a TPU which has the nature of the rubbery and hard components considerably modified compared to the aforementioned DESMOPAN TPUs. The chemical characteristics of TEXIN DP 1089 TPU are recorded in Table 2. Good adhesion was exhibited between the LLDPE sub-tube and TEXIN DP 1089 TPU jacket. The composite tube was used in the manufacture of signal tube which was tested in diesel oil in the same manner as the signal tube of Example 1 and the testing results are recorded in Table 1.

The results in Table 1 show that signal tube comprising a TEXIN DP 1089 TPU jacket exhibits oil resistance which is significantly better than that of signal tube having PE or DESMOPAN TPU's.

Tensile testing carried out on the TEXIN DP 1089 TPU jacketed signal tube revealed a breaking stress which is similar to that of conventional PE jacketed signal tube. Upon reaching the point of breaking, the TPU jacket of signal tube of the current example shrank significantly, indicating a good mechanical adhesion between the jacket and the sub-tube.

EXAMPLE 5

Five types of Composite tubes were formed by overextruding sub-tubes of LLDPE with the following:

(a) HDX (b) TEXAN 1089

(c) MILES 445

(d) MILES 455

(e) MILES 470 D

The five types of composite tubes formed were closed at the ends and left to soak in MOBIL diesel fuel at 50° C. for 20 days. The percentage uptake of oil was measured periodically for each type of tube and the results are recorded in FIG. 1.

The results of FIG. 1 show that the TEXIN 1089 and MILES TPU jacketed composite tubes show superior oil resistance compared to the composite tube having an HDX jacket. The composite tube comprising MILES 470 (a particularly hard grade of polyester based polywethane compared to MILES 445 or 455 TPU) showed the most superior oil resistance of the five types of composite tubes tested.

EXAMPLE 6

Sub-tubes of LLDPE were overextruded with jackets of MILES 470 D TPU to form composite signal tubes. A second type of composite signal tube was formed by using CHEMLOCK adhesive to adhere a jacket of MILES 470 D TPU to sub-tubes of LLDPE. The two types of composite signal tubes formed were tested for oil resistance according to the method of Examples 1 and 5 but no difference in oil resistance characteristics were apparent.

Samples of overextruded composite tube and the adhered composite tube were both subjected to severe reverse prime testing. This involves attaching one end of a piece of signal tube to a detonator then bending the piece of signal tube over on itself, 40 mm from the detonator and holding the signal tube in position using an electrical cable tie. The signal tube is then initiated at its free end to see if the initiation signal can pass through the bend and initiate the detonator. This is a severe test which is meant to represent a field situation which may arise if a signal tube is not properly located in a primer.

The composite signal tube comprising an LLDPE sub-tube overextruded with MILES 470 D TPU exhibited an acceptable performance of 16 failures per 250 initiations. The composite signal tube comprising an LLDPE sub-tube adhered to a MILES 470 D TPU jacket showed an exceptionally good performance of 1 failure per 150 initiations. This shows that the use of CHEMLOCK adhesive to adhere the TPU jacket to the LLDPE sub-tube provides a composite tube which is particularly resistant to damage or impaired performance due to deformation.

While the invention has been explained in relation to its preferred embodiments it is to be understood that various modifications thereof will become apparent to those skilled in the art upon reading the specification. Therefore, it is to be understood that the invention disclosed herein is intended to cover such modification as fall within the scope of the appended claims.

TABLE 1

| Example | (Sub-tube)/ (Jacket) | No. of Days Before Failure to Fire. |
|---|---|---|
| Comp. Ex. | LLDPE/PE | 2 |
| Example 1 | LLDPE/ DESMOPAN 385 TPU | 7 |
| Example 2 | LLDPE/ DESMOPAN KU 2-8710 | 14 |
| Example 3 | LLDPE/ DESMOPAN KA 8487 TPU | 8 |
| Example 4 | LLDPE/ TEXIN DP 1089 TPU | >39 |

TABLE 2

| | DESMO-PAN 385 | DESMO-PAN KU 8487 | DESMO-PAN KU 2-8710 | TEXIN DP 1089 |
|---|---|---|---|---|
| Example No. | 1 | 2 | 3 | 4 |
| Hardness | 86 | 90 | 86 | 50 |
| Shore | A | A | A | D |
| Polyester | 1 mol | 1 mol | 1 mol | 1 mol |
| Chain Extender | 2.75 | 3.25 | 2.75 | 6.00 |
| MDI | 3.75 | 4.25 | 3.75 | 7.00 |

I claim:

1. A signal tube of improved oil resistance having a sub-tube comprising polyethylene and an outer jacket comprising a thermoplastic polyurethane resin of the polyester type.

2. A signal tube of improved oil resistance having a sub-tube comprising polyethylene and an outer jacket comprising a thermoplastic polyurethane resin of the polyester type formed from a reactant mixture comprising, a polyester polyol, a chain-extending agent, and a diisocyanate, wherein for every mole of polyester polyol present, the chain extending agent is present in a proportion of from 2.5 to 7 and the diisocyanate is present in a proportion of from 3 to 8.

3. A signal tube according to claim 2 wherein the chain-extending agent is a dihydroxyl chain-extending agent having a molecular weight of 400 or less.

4. A signal tube according to claim 3 wherein the chain-extending agent further comprises aliphatic, cycloaliphatic or aromatic dihydroxyl compounds or diols having from 2 to 10 carbon atoms.

5. A signal tube according to claim 2 wherein the chain-extending agent comprises a mixture of 2 or more diols.

6. A signal tube according to claim 2 wherein the chain-extending agent is in admixture with another compound.

7. A signal tube according to claim 2 wherein the chain-extending agent is combined with monofunctional or tri-functional compounds.

8. A signal tube according to claim 2 wherein said polyester polyols has an average molecular weight between 500 and 5000 and an average functionality of from 1.8 to 2.25.

9. A signal tube according to claim 2 wherein the polyester polyol is chosen from the group comprising poly (alkylenealkanedioate) diols and poly(oxycaproyl) diols.

10. A signal tube according to claim 2 wherein the diisocyanate is present in a quantity sufficient to provide an overall reaction index of between 0.8 and 1.2.

11. A signal tube according to claim 2 wherein the diisocyanate is chosen from the group comprising aliphatic, aromatic or alicyclic isocyanates or mixtures thereof.

12. A signal tube according to claim 2 wherein the thermoplastic polywethane resin further comprises additives.

13. A signal tube according to claim 2 wherein the outer jacket is overextruded onto the sub-tube.

14. A signal tube according to claim 2 wherein the outer jacket is adhered to the sub-tube.

* * * * *

UNITED STATES PATENT AND TRADEMARK OFFICE

CERTIFICATE OF CORRECTION

PATENT NO. : 5,625,162
DATED : April 29, 1997
INVENTOR(S) : Rodney Appleby

It is certified that error appears in the above-identified patent and that said Letters Patent is hereby corrected as shown below:

On the title page, item [73], should read
-- Assignee: Initiating Explosives Systems PTY LTD--.

Signed and Sealed this

Ninth Day of December, 1997

*Attest:*

*Attesting Officer*

BRUCE LEHMAN

*Commissioner of Patents and Trademarks*